United States Patent [19]

Kidd

[11] 4,259,901

[45] Apr. 7, 1981

[54] GUIDE FOR IMPRINTING BOTTLE TOPS

[76] Inventor: Leonard A. Kidd, 4202 N. Romero Rd, #23, Tucson, Ariz. 85705

[21] Appl. No.: 8,081

[22] Filed: Jan. 31, 1979

[51] Int. Cl.[3] ..... B41F 17/00

[52] U.S. Cl. ..... 101/42; 101/105

[58] Field of Search ..... 101/41, 42, 35, 333, 101/334, 368, 379, 105

[56] References Cited

U.S. PATENT DOCUMENTS

| | | | |
|---|---|---|---|
| 1,236,801 | 8/1917 | Willard | 101/334 X |
| 1,380,509 | 6/1921 | Wysong | 101/35 |
| 1,779,174 | 10/1930 | Larsen | 101/41 UX |
| 3,019,762 | 2/1962 | Hautz | 101/368 UX |
| 3,389,654 | 6/1968 | Hirt | 101/35 |
| 4,077,319 | 3/1978 | Edmisten | 101/379 X |

FOREIGN PATENT DOCUMENTS

| | | | |
|---|---|---|---|
| 424947 | 3/1935 | United Kingdom | 101/41 |

*Primary Examiner*—Clifford D. Crowder
*Attorney, Agent, or Firm*—Cahill, Sutton & Thomas

[57] ABSTRACT

A truncated cone shaped guide extends downwardly from the imprinter of a conventional price marking stamp for guiding and locating the imprinter upon the top surface of a bottle cap.

1 Claim, 3 Drawing Figures

GUIDE FOR IMPRINTING BOTTLE TOPS

The present invention relates to imprinters and, more particularly, to guides for imprinters.

Imprinters of various types are well known for marking goods with a printed message, such as pricing information. The following United States Patents are representative of these types of devices: U.S. Pat. Nos. 774,675, 1,391,856, 1,420,376, 2,966,116, 3,952,653 and 4,003,309. To precisely locate the position of the imprinter, various guides have been developed. U.S. Pat. No. 743,762 describes laterally oriented pointers for aligning an imprinter with preexisting horizontal lines. U.S. Pat. No. 2,402,651 is directed to pivotable laterally oriented fingers for locating an imprinter with respect to a known point. U.S. Pat. No. 3,703,142 incorporates a spring loaded center pin for orienting an imprinter with respect to a center point. U.S. Pat. No. 3,543,681 describes guide means for locating a cylindrical surface with respect to an imprinter. U.S. Pat. No. 2,699,112 describes a conventional price marking stamping device which incorporates side plates for positioning the stamping device with respect to a shelf edge mounted price sticker.

In grocery stores, price marking stamping devices of the type shown and described in U.S. Pat. No. 2,699,112 are generally used to print the price upon the goods. Usually, the location on the goods of the printed price is non-critical and sufficient alignment is readily acheived without great diligence in locating the price marking stamping device. However, for goods having a limited space or location in which the price must be printed, precise, physical location of the imprinting elements must be achieved.

Goods which represent a particular problem are bottled goods. These bottled goods generally have a cylindrical surface upon which legible imprinting is difficult. Additionally, the bottled goods are generally stored by standing them up adjacent to one another and rendering the price thereof generally visually inexcessible if printed upon the vertical surfaces of a standing bottle.

The area of a standing bottle which is readily viewable by a prospective purchaser is the cap or top of the bottle. However, the physical dimensions and the operation of widely used price marking stamping devices renders it extremely difficult to imprint the price accurately and legibly upon the cap or bottle top surface.

It is therefore a primary object of the present invention to provide a guide for price marking stamping devices.

Another object of the present invention is to provide a guide for imprinting with a price marking stamping device the price upon the top of bottled goods.

Yet another object of the present invention is to provide a self-centering guide for a price marking stamping device to imprint the price upon bottle caps.

Still another object of the present invention is to provide a truncated cone shaped guide for guiding a price marking stamping device with respect to the cap of a bottle.

A further object of the present invention is to provide a guide readily attachable to a conventional price marking stamping device.

A yet further object of the present invention is to provide an inexpensive guide useable in conjunction with a price marking stamping device to imprint bottle tops with the price.

A still further object of the present invention is to provide a guide which automatically aligns the imprinter of a price marking stamping device with the top surface of a bottle cap.

These and other objects of the present invention will become apparent to those skilled in the art as the description there of proceeds.

The present invention may be described with greater specificity and clarity with reference to the following drawings, in which.

Figure 1:
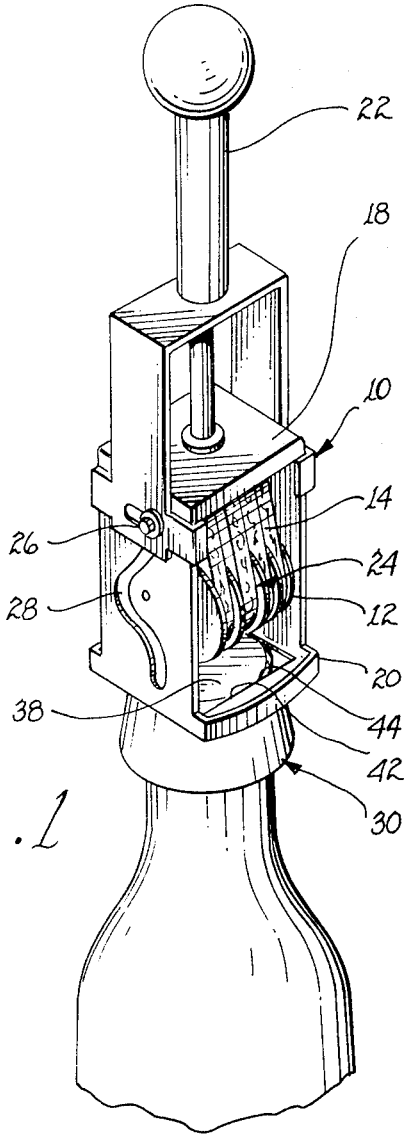
FIG. 1 is a perspective view illustrating engagement of a price marking stamping device with a bottle.

Many grocery stores employ conventional price marking stamping devices of the type illustrated in FIG. 1 and identified by reference numeral 10 for marking the price upon the goods. The universal appeal of this type of device is that it includes a plurality of thumb wheels 12 supporting belts 14, which belts support indicia 16 (see FIG. 2). An ink pad 18 repetitively inks the indicia after each use of the device. The device is used by locating base member 20 upon a surface to be imprinted. A downward force applied to handle 22 causes imprinter 24 to travel downwardly, rotate a 180° (through operation of shaft 26 within slot 28) and leave an imprint corresponding to certain of indicia 16 upon the underlying surface. The indicia printed is easily changeable by actuating thumb wheels 12 to bring a particular indicia of each belt 14 into registration with ink pad 18 when printer 24 is in the position shown in FIG. 1.

For planar surfaces at least commensurate in size with the dimensions of base plate 20 and where the exact positioning of the indicia to be imprinted is not critical, the price marking stamping device is relatively easily used. To mark the tops of bottle caps, however, relatively accurate positioning of the base plate must be performed to insure that the printed price is not smudged due to inadvertent lateral movement of the imprinter during imprinting and that all of the printing constituting the price appear upon the bottle cap. Such positioning can be performed if the operator is meticulous and takes sufficient care to accurately locate the imprinter. As a practical matter, most grocery clerks attempt to mark the prices relatively rapidly and sufficient care is not always exercised to insure legible price marking upon the caps of bottled goods.

Figure 2:
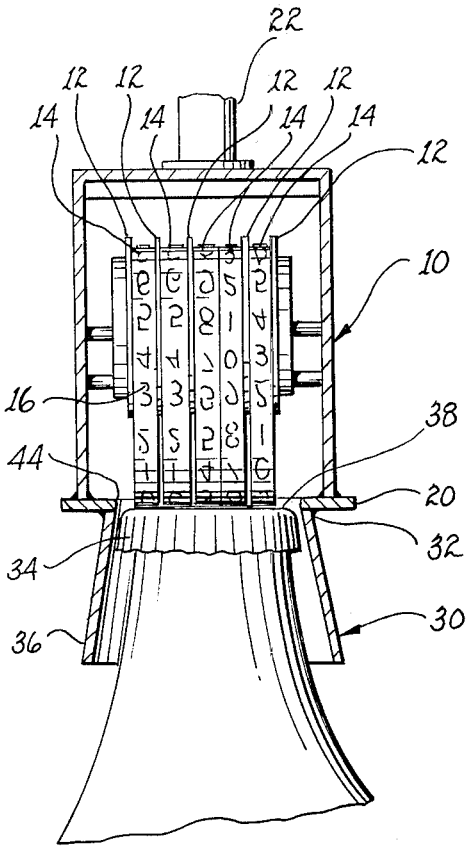
FIG. 2 is a front partial cross sectional view.
Figure 3:
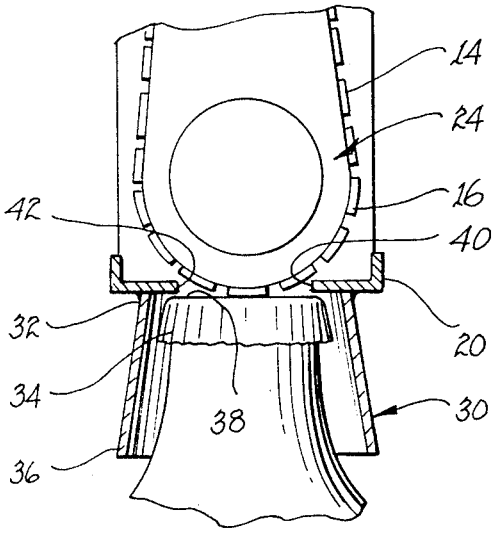
FIG. 3 is a lateral cross sectional view.

By attaching a downwardly extending guide 30 to base plate 20, accurate positioning of price marking stamping device 10 on a bottle cap will occur with only minimum effort on the part of the clerk. Referring jointly to FIGS. 1, 2 and 3, guide 30 is a truncated cone shaped shroud which may be welded, braised or otherwise attached to base plate 20 in a depending manner. The circumference of upper end 32 of the guide is somewhat greater than that of cap 34 to insure general concentricity therewith and yet incorporate sufficient tolerance to preclude jamming. The circumference of lower end 36 is greater in diameter than that of the upper end of facilitate initial insertion of the bottle cap on top within guide 30. The resulting truncated cone shape tends to guide price marking stamping device 10 onto the bottle cap or top with little effort on the part of the clerk.

Proper vertical spacing of imprinter 24 with respect to top surface 38 of cap 34 is maintained by opposed pairs of edges 40 and 42 defining opening 44 being normally dimensioned insufficiently apart from one another and preclude penetration of the cap through the aperture. Thereby, these edges rest upon top surface 38 of the cap and correctly vertically position the indicia of the imprinter with respect to the cap.

Cone 30 is oriented with respect to base plate 20 such that indicia 16, appearing at the bottom of the imprinter 24 after the imprinter has been rotated a 180° to the position ready for printing, will be generally centered upon top surface 38. Thereby, the price printed upon the cap is not smudged as guide 30 tends to maintain the price making stamping device laterally immobile during a printing; and, all of the indicia constituting the price will be printed upon the top surface of the cap.

From the above description, it becomes apparent that a case or other group of bottled goods may be marked relatively rapidly with a price marking stamping device having an attached guide without particular care in locating the device with respect to the cap of each bottle. In fact, all a clerk need do is bring the top of the bottle into general registration with cone 30. Further downward movement of the price marking stamping device will automatically accurately bring base plate 20 into registration with the top surface of the bottle cap. Upon such registration, downward movement of handle 22 will actuate imprinter 24 to print the price upon the underlying cap surface. For the reasons stated above, the location of the printed price will be legible and generally centered upon the cap.

From experience it has been found that the length of guide 30 may be as short as ½" and yet it will accurately guide the cap of a bottle into position for imprinting. The angle of rotation of the cone is non-critical provided only that the lower edge is sufficiently wide to readily receive the cap of the bottle and that the upper edge defines a large enough circumference to prevent jamming of the bottle cap while precluding excessive lateral movement of the imprinter with respect to the cap.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A manually transportable apparatus for serially marking the price upon the cap of each of a plurality of capped bottles by relative positional movement between said apparatus and the bottles, said apparatus comprising in combination:

(a) a price marking stamping device for marking the price, said device including an imprinter settable to reflect the price of the bottle to be marked and which imprinter is relocatable with respect to said device to a fixed position to which said imprinter can extend for imprinting coincident with the operation of imprinting the price;

(b) an apertured base member for providing the sole support for said device upon the cap during imprinting of the price upon the cap, said base member including an aperture for defining the area within which said imprinter will print the price, said base member being mounted upon said device at a location which will permit penetration of said imprinter through said aperture upon relocation of said imprinter to the fixed position; and (c) a frusto conically shaped shroud means depending from said base member for guiding the cap into registration with said aperture and for locating the surface of the cap to be imprinted adjacent said base member and commensurate with the fixed position of said imprinter, said shroud being devoid of means for supporting said device upon the cap.

* * * * *